United States Patent [19]

Hazelrigg

[11] 4,252,093

[45] Feb. 24, 1981

[54] INTERNAL COMBUSTION ENGINE

[76] Inventor: Henry A. Hazelrigg, 2730 Ozark Ave., Cabool, Mo. 65689

[21] Appl. No.: 822,650

[22] Filed: Aug. 8, 1977

[51] Int. Cl.[3] ..... F02D 13/06

[52] U.S. Cl. ..... 123/198 F; 123/90.16; 123/90.32; 123/90.39

[58] Field of Search ..... 123/198 F, 90.32, 90.15, 123/90.16, 90.39

[56] References Cited

U.S. PATENT DOCUMENTS

| | | | |
|---|---|---|---|
| 4,050,435 | 9/1977 | Fuller, Jr. et al. | 123/198 F |
| 4,151,817 | 5/1979 | Mueller | 123/198 F |
| 4,151,824 | 5/1979 | Gilbert | 123/198 F |

*Primary Examiner*—Ira S. Lazarus

*Attorney, Agent, or Firm*—Howard I. Podell

[57] ABSTRACT

Internal combustion engine valve rocker arms adaptable for changing the horsepower output of an equipped engine, which rocker arms may be alternately set to prevent operation of the valves of cylinders that are to be selectively deactivated. Each rocker arm is formed of two radial members pivotally mounted to a common shaft that are joined together by a slidable key which may be shifted to a position in which the two radial members are disengaged from each other so that the first radial member reciprocated by the camshaft push rod does not transmit motion to the second radial member bearing on the valve lever. A latch device retains the second radial member of a conventional valve rocker arm in the open valve position, when the radial members are disengaged from each other.

5 Claims, 8 Drawing Figures

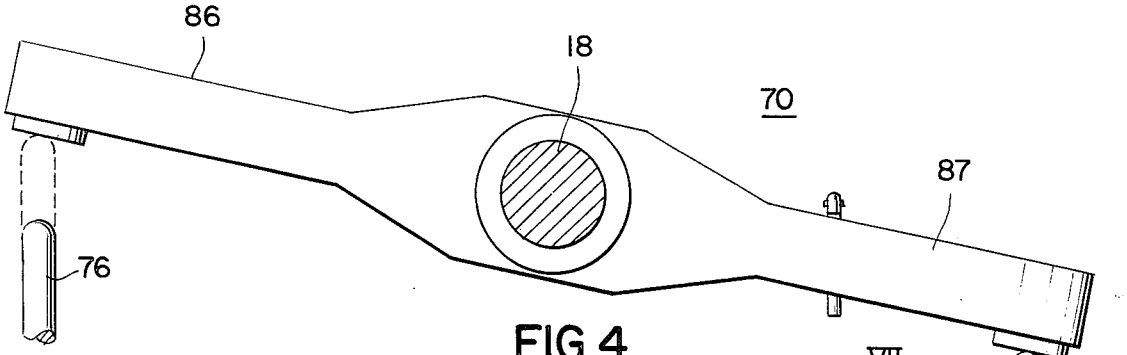
FIG.4
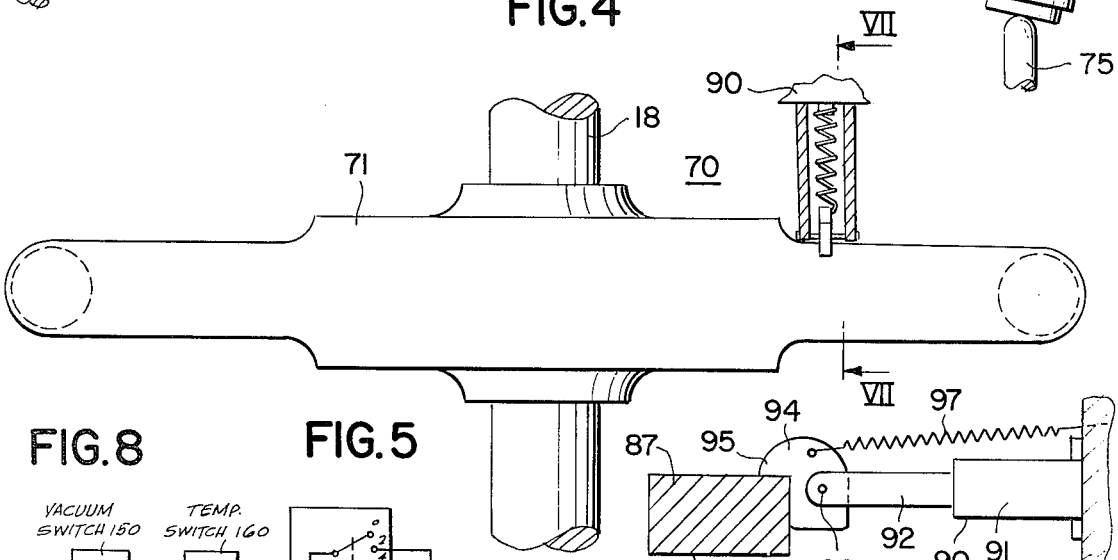
FIG.5
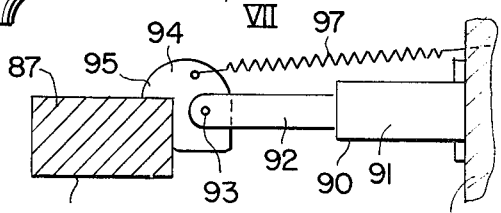
FIG.7
FIG.8
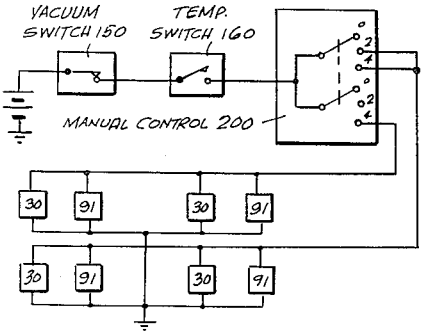
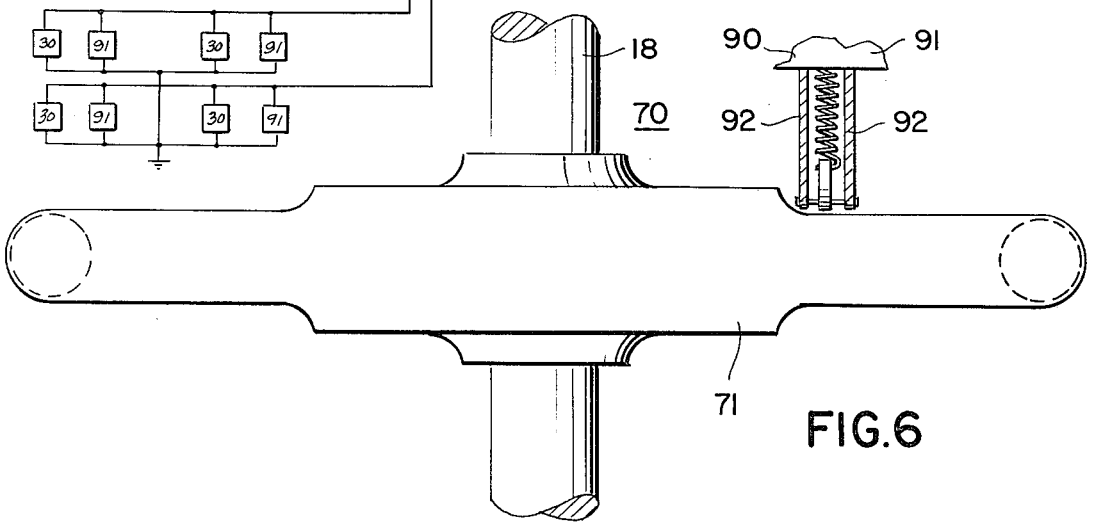
FIG.6

INTERNAL COMBUSTION ENGINE

SUMMARY OF THE INVENTION

My invention is an internal combustion engine valve rocker arms adaptable for changing the horsepower output of an equipped engine, which rocker arms may be alternately set to prevent operation of the valves of cylinders that are to be selectively deactivated. Each rocker arm is formed of two radial members pivotally mounted to a common shaft that are joined together by a slidable key which may be shifted to a position in which the two radial members are disengaged from each other so that the first radial member reciprocated by the camshaft push rod does not transmit motion to the second radial member bearing on the valve lever. A latch device retains the second radial member of a conventional valve rocker arm in the open valve position, when the radial members are disengaged from each other.

BRIEF DESCRIPTION OF THE DRAWINGS

The objects and features of the invention may be understood with reference to the following detailed description of an illustrative embodiment of the invention, taken together with the accompanying drawings in which:

FIG. 4 is a side view of an exhaust valve rocker arm of the invention in the deactivated mode;

FIG. 5 is a plan view of the exhaust valve rocker arm in the deactivated mode;

FIG. 6 is a plan view of the exhaust valve rocker arm in the normal mode;

FIG. 7 is a sectional view taken along line 7—7 of FIG. 5; and

FIG. 8 is a schematic view of the control circuit.

DESCRIPTION OF THE PREFERRED EMBODIMENT

Figure 1:
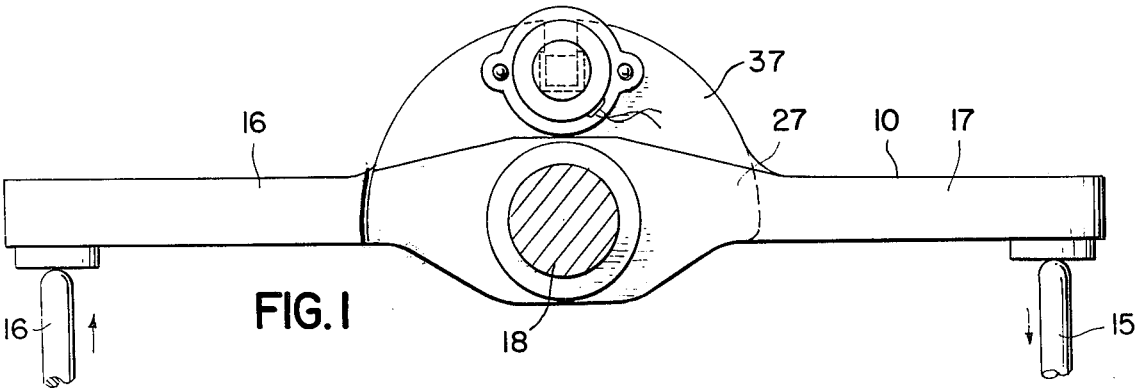
FIG. 1 is a side view of an intake valve rocker arm of the invention.
Figure 2:
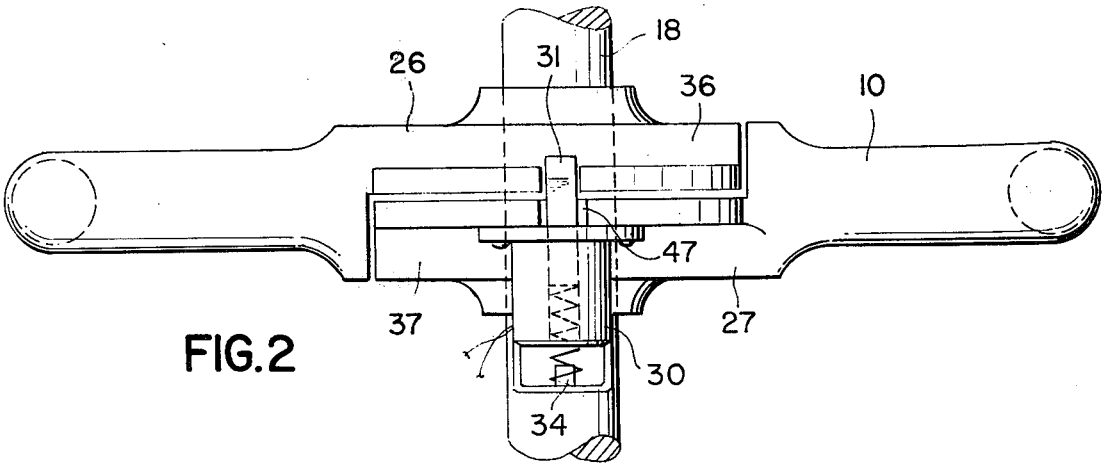
FIG. 2 is a plan view of the intake valve rocker arm in the normal mode.
Figure 3:
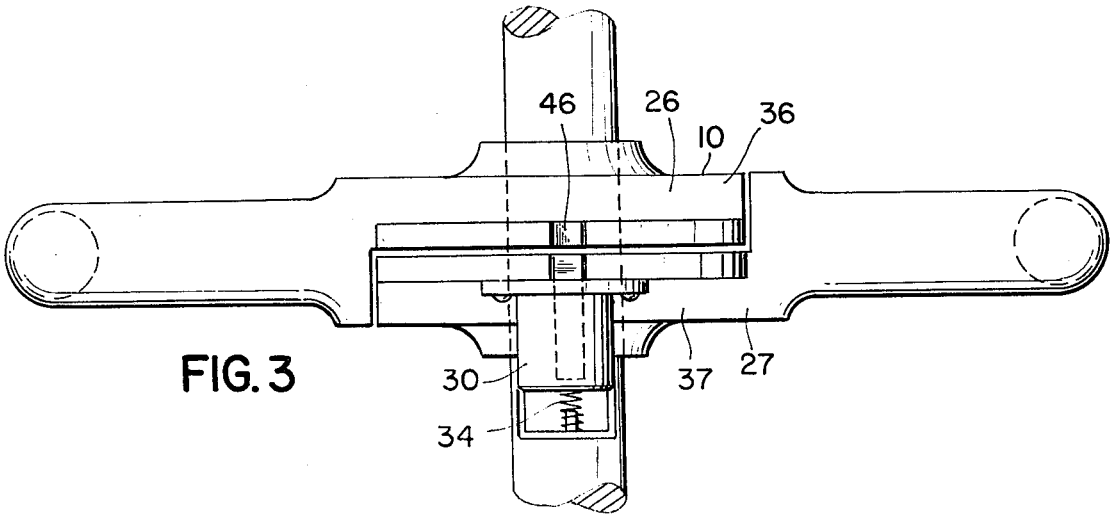
FIG. 3 is a plan view of the intake valve rocker arm in the deactivated mode.

Turning now descriptively to the drawings, in which similar reference characters denote similar elements throughout the several views, FIGS. 1–3 illustrate intake valve rocker arm assembly 10 which in the normal mode of operation shown in FIGS. 1–2, causes intake valve stem 15 to vertically travel downwards to open the intake valve when push rod 16 travels vertically upward in response to rotate of the camshaft (not shown) of a multi-cylinder internal combustion engine. In the deactivated mode, the linkage between push rod 16 and valve stem 15 is disengaged to permit the valve spring (not shown) to rotation valve stem in the downward position of closure regardless of the continuing reciprocating vertical travel of push rod 16, so as to prevent fuel from flowing into the cylinder regulated by the intake valve.

Rocker arm assembly 10 is formed of two arms 16, 17 each pivotally mounted about fixed rocker arm shaft 18, with the hub section 26, 27 of arms 16, 17 respectively shaped to freely clear each other. A semi-circular bracket section 36, 37 extends respectively from each hub section 26, 27 upwardly over shaft 18, with the planes of bracket sections 36, 37 being substantially in parallel orientation.

Each bracket section 36, 37 is formed with a through slot 46, 47 with slots 46, 47 aligned along common axes when arms 16, 17 extend in opposite directions along a common line. A solenoid 30 is bolted to bracket section 37, with an external slidable key 31 projecting from solenoid 30 into slot 47 fixed internally to the armature of solenoid 30.

A spring 34 in solenoid 30 biases key 31 into the slot 46 of bracket 36 when the solenoid is de-energized as shown in FIGS. 1, 2 so that key 31 latches arms 16, 17 together through slots 46, 47 in the normal mode of operation. Energization of solenoid 30 causes key 31 to retract out of slot 46 as shown in FIG. 3 so that arms 16, 17 are disengaged from each other. Since push rod 16 continually reciprocates during engine operation, arm 16 will continually pivotally reciprocate to cause slots 46 and 47 to align together at least once during each cycle of push rod travel so as to permit free slidable movement of key 31 in response to the operation of solenoid 30. When solenoid 30 is energized rocker arm section 17 will not be pivoted and intake valve stem 15 will remain in the closed position, preventing fuel from reaching the cylinder of that valve.

FIGS. 4–6 illustrate the exhaust rocker arm assembly 70 that operates exhaust valve of the same cylinder (not shown).

Rocker arm assembly 70 is formed of a unitary rocker arm unit 71 centrally pivotally mounted about rocker arm shaft 18 in conventional manner with arm 87 of rocker arm unit pushing exhaust valve stem 75 down when arm 86 is lifted by push rod 76.

A latch assembly 90 is mounted to the engine block 100 to latch rocker arm section in the down position, shown in FIG. 4, when valve stem 75 is to be retained in the open valve position (down) independently of the reciprocal travel of push rod 76. Latch assembly 90 is formed of a solenoid 91, the armature of which is joined to a pair of parallel arms 92 that are pivotally linked by a pin 93 to a shaped cam 94 formed with an external projection 95 that catches the top of arm 87 of in the extended actuated position of solenoid 91, to retain arm 87 latched in the down position shown in FIGS. 4, 5, and 7 to deactivate the cylinder associated with exhaust valve stem 75. A tension spring 97 is pivotally mounted to cam 94 above pivot pin 93 so as to rotate the lower portion of cam 94 against the bottom of the rocker arm 87 in the initially actuated position of the solenoid as the rocker arm 87 travels downward so as to rotate the projection 95 against the bias of spring 97 over the top of arm 87 as the arm travels further downwards to the latched position.

As shown in FIG. 8, each pair of solenoids 30 and 91 controlling the intake and exhaust valve rocker arm assemblies 10 and 70 respectively of a pair of specific engine cylinders of an eight cylinder engine are connected in parallel so that with the solenoids 30 and 91 of a given solenoid actuated, that particular cylinder is deactivated.

The solenoids 30 and 91 are connected in series to a normally closed intake vacuum switch 150 in series with a normally open engine temperature switch 160 in series with a three-position, double pole manual control switch 200. Vacuum switch 150 opens above a specific engine intake manifold pressure so as to reactivate all cylinders during periods of high engine power demand and engine temperature switch opens below a specific engine temperature so as to reactivate all cylinders when the engine is below its normal operating temperature.

Manual control switch 200 enables the driver to set the switch to position 0 at which all cylinders are activated or position 2 at which two cylinders are deactivated, or position 4 at which four or eight engine cylinders are deactivated.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A rocker arm assembly adaptable for operation in an internal combustion engine in which a rocker arm unit is employed to transmit linear motion of a push rod to a valve stem to cause the valve stem to move in a linear direction, said rocker arm assembly fitted with means to alternatively engage or disengage the linkage between a said push rod and a said valve stem, when installed as a rocker arm unit of a said engine, in which the rocker arm assembly is formed of two arm members, each formed at a first end section with first means to rotatably fit about a common shaft, said first end section formed with second means to engage a common pin, each said second means located at a spaced similar distance from the center of rotation of said first means about a said shaft, such that with said second means engaged in both said first end sections, said two arm members are positively rotatably fixed with relation to each other in a position in which they each extend in opposed directions from said first means, when they are both rotatably mounted on a said common shaft.

2. The combination as recited in claim 1 together with third means to disengage the common pin from the second means of at least one arm member so that with both arm members rotatably mounted on a common shaft, they are free to rotate independently of each other about said shaft.

3. An internal combustion engine in which a rocker arm assembly as recited in claim 2 is mounted to link a first push rod with the valve stem of an intake valve of a specific engine cylinder, so with that the common pin disengaged from the second means of at least one arm member, the said intake valve remains in the closed position during operation of the engine.

4. The internal combustion engine as recited in claim 3 in which the exhaust valve stem of the said specific engine cylinder is linked to a second push rod by a rocker arm formed of two arm members fixed to a common intermediate section of the rocker arm, together with selective latch means to latch the said rocker arm in a latched position in which one said arm member maintains the said valve stem in the open position of the exhaust valve during operation of the engine, said latch means being mounted to the engine block in a location so as to be free of engagement with the rocker arm in the unlatched position of the latch means.

5. The engine as recited in claim 4, together with first electrical means to control the said third means that serves to disengage the common pin, and second electrical means to control the latch means, together with control means responsive to the intake vacuum and temperature of the engine, which control means operates said first and second electrical means to maintain an intake valve in the closed position and an exhaust valve in the open position of a specific engine cylinder when the engine, is in operation during periods of low engine power demand and at a suitable engine temperature.

* * * * *